US006962299B2

(12) United States Patent
Hakala

(10) Patent No.: US 6,962,299 B2
(45) Date of Patent: Nov. 8, 2005

(54) NOZZLE DEFLECTOR ELEMENT

(76) Inventor: John E. Hakala, 57 Golden Glen Dr., Simi Valley, CA (US) 93065

( * ) Notice: Subject to any disclaimer, the term of this patent is extended or adjusted under 35 U.S.C. 154(b) by 118 days.

(21) Appl. No.: 10/210,491

(22) Filed: Aug. 1, 2002

(65) Prior Publication Data

US 2004/0021007 A1 Feb. 5, 2004

(51) Int. Cl.[7] ..... B05B 1/26; B05B 1/34

(52) U.S. Cl. ..... 239/499; 239/461; 239/489; 239/494

(58) Field of Search ..... 239/222.13, 222.15, 239/222.17, 222.19, 222.21, 223, 224, 499, 461, 489–494

(56) References Cited

U.S. PATENT DOCUMENTS

| | | | | |
|---|---|---|---|---|
| 458,014 | A | | 8/1891 | Caswell |
| 533,367 | A | | 1/1895 | McBoyle |
| 890,044 | A | | 6/1908 | Godbey |
| 1,228,658 | A | | 6/1917 | Gaines |
| 1,364,163 | A | | 1/1921 | Wampler |
| 1,434,757 | A | | 11/1922 | Thomas |
| 2,065,549 | A | | 12/1936 | Balensiefer |
| 3,085,754 | A | | 4/1963 | Thompson |
| 3,146,823 | A | | 9/1964 | Loveland |
| 3,292,868 | A | | 12/1966 | McCartney et al. |
| 3,648,931 | A | * | 3/1972 | Jacobs ..... 239/248 |
| 3,650,478 | A | | 3/1972 | Jones |
| 3,806,034 | A | * | 4/1974 | Purtell ..... 239/230 |
| 3,856,207 | A | * | 12/1974 | Rees, Jr. ..... 239/230 |
| 4,073,438 | A | * | 2/1978 | Meyer ..... 239/227 |
| 4,130,247 | A | | 12/1978 | Healy |
| 4,487,368 | A | * | 12/1984 | Clearman ..... 239/229 |
| 4,596,362 | A | * | 6/1986 | Pralle et al. ..... 239/233 |
| 5,158,231 | A | | 10/1992 | Christen et al. |
| 5,240,184 | A | | 8/1993 | Lawson |
| 5,267,689 | A | * | 12/1993 | Forer ..... 239/11 |
| 5,642,861 | A | | 7/1997 | Ogi |
| 6,176,440 | B1 | * | 1/2001 | Elliott ..... 239/222.21 |
| 6,530,532 | B1 | * | 3/2003 | Santiesteban et al. ..... 239/233 |

* cited by examiner

*Primary Examiner*—Davis Hwu
(74) *Attorney, Agent, or Firm*—Colin P. Abrahams

(57) ABSTRACT

A water deflector for use with a nozzle is disclosed. The nozzle has a water channel including a water inlet and a mouth from which water is dispersed. The water deflector comprises a shaft for passing through the water channel of the nozzle, the shaft having a lower end and an outer end, and an aperture along a part of its length between the lower and outer ends. A base member connects to the shaft at the lower end thereof, and has a width sufficiently large to prevent, in use, the base member from entering the water inlet of the water channel. Water passing through the water channel is deflected by the water deflector to alter the pattern of watering about the nozzle.

19 Claims, 5 Drawing Sheets

NOZZLE DEFLECTOR ELEMENT

FIELD AND BACKGROUND OF THE INVENTION

This invention relates to sprinkler heads and nozzles. Particularly, the invention relates to such sprinkler heads and nozzles used in outdoor irrigation systems, such as the watering of lawns and plants in residential, commercial and industrial settings.

As a general rule, a sprinkler device has a sprinkler head. The sprinkler head has an attached or an integrated nozzle. The water flows through the head, to the nozzle, and from the nozzle to the area to be irrigated.

Conventional sprinklers or irrigation systems typically comprise a series of pipes, connected to each other end-to-end, the pipes being connected to a water source, such as an outdoor faucet. The pipes are constructed so as to, for example, extend about the perimeter of an area requiring watering or irrigation, or may be laid in some other fashion so that effective watering can occur. At periodic points along the length of the pipes, water outlets are constructed, whereby water is diverted from the pipe, passes along the outlet, and typically exits through a sprinkler head or nozzle which distributes the water in a particular coverage pattern so as to provide water to plants and lawn in that area. The spacing of the sprinkler heads or nozzles along the pipe is determined based not only upon the type of plant requiring watering, but also upon the spread and/or range of a particular nozzle, namely, the specific area to which the water is delivered.

In certain situations, the sprinkler head or nozzle may be such that the water is delivered as a drip or in a steady low volume stream, but, in many situations, the sprinkler head or nozzle is not intended to deliver water to a particular point or very small area, but to provide watering over a much larger area.

While a variety of styles and shapes of lawn and garden sprinkler heads exist, nearly all of these are designed and tooled so as to disperse water which is generally in a direction upward and away from the head. A common problem with such sprinkler heads or nozzles is that water is not distributed evenly and consistently over the entire area which that nozzle is intended to cover. As a result, the area on the ground nearer the head may receive little, or even no, water, while areas further from the head will tend to receive almost all of the water. This situation often means that plants and lawn in the vicinity or adjacent the sprinkler heads must be separately irrigated, either by hand, or by an adjacent sprinkler head. The result is that it often becomes necessary to place the sprinkler heads and nozzles at closer intervals with respect to each other to ensure dispersal patterns to cover unwatered areas very near a particular or adjacent head. This, in turn, may result in significant overlap of areas to be watered, in order to achieve the objective of providing water to those areas which are missed by adjacent sprinklers heads or nozzles.

Unfortunately, the placement of the sprinkler heads and nozzles, even in overlapping fashion, does not always address the problem of uneven coverage. Moreover, this type of placement is often not feasible, and generally uneconomical, since, in order to water all areas, certain areas must receive more water. Therefore, while placement of sprinkler heads to cause overlapping watering may address the problem of providing water to all areas, this still does not address the issue of consistent and even watering of all areas within a sprinkler nozzle's intended coverage.

SUMMARY OF THE INVENTION

In one aspect, the present invention therefore provides for an irrigation or sprinkler head nozzle or head which contains or includes a deflector in the path of the water dispensed, the deflector being configured and dimensioned so as to intercept a portion of the water exiting the sprinkler head or nozzle in such a way that the coverage area is increased and/or optimized.

In another aspect, the invention relates to water deflection devices themselves, the deflection devices being shaped and configured so as to be received within an existing or adapted sprinkler head or nozzle to thereby intercept a portion of a water stream being dispensed from that nozzle and to provide a more consistent and even coverage for watering the area around that sprinkler head or nozzle.

Preferably, the deflector device, or deflector within a sprinkler head, may take many different forms and shapes, and these will vary according to the nature of the area being watered by the sprinkler head, the design of the head or nozzle, and the typical deficiency with respect to such sprinkler head in reaching all areas evenly.

According to one aspect of the invention, there is provided a water deflector for use with an irrigation nozzle having a water channel including a water inlet and a mouth from which water is dispersed, the water deflector comprising: a shaft for passing through the water channel of the irrigation nozzle, the shaft having a lower end and an outer end, and an aperture part way along its length between the lower and outer ends; and a base member connected to the shaft at the lower end thereof, the base member having a width sufficiently large to prevent, in use, the base member from entering the water inlet of the water channel; wherein a portion of the water passing through the water channel is deflected by the water deflector to alter the pattern of watering about the irrigation nozzle.

Preferably, the shaft is in the form of an elongate plate, which may be flat or curved, and the base member comprises a substantially linear plate member. The water deflector may further comprise a flange mounted on the shaft above the base member, the flange in use positioning the shaft optimally within the water channel. The shaft is configured with respect to its length and shape so as to provide optimal water distribution for the pattern of watering about the irrigation nozzle.

Preferably, the aperture comprises an elongate slot formed in the shaft near the upper end thereof, such that the slot is formed at a position wherein it will be located at or near the mouth of the irrigation nozzle. The shaft may be bent at its end opposite that of the base member in an arcuate form.

According to another aspect of the invention, there is provided an irrigation nozzle comprising a water channel having an inlet end for receiving water from a source and an outlet end from which the water is discharged in a pattern to an area adjacent the irrigation nozzle; and a water deflector plate near or at the outlet end, the water deflector plate comprising a substantially flat shaft and means for securing the shaft to the irrigation nozzle.

The shaft may comprise a first end attached near the outlet end of the water channel, and a second end remote from the outlet end. Alternatively, the shaft may further comprise a base member, the base member being located outside the water channel at the inlet end thereof and connected to an end of the shaft, the shaft further comprising a flange within the water channel for optimal positioning of the shaft within the water channel.

Preferably, the shaft comprises an aperture, preferably a elongate slot, to permit flow of water therethrough.

BRIEF DESCRIPTION OF THE DRAWINGS

FIG. 17(*b*) is a diagrammatic representation of an integrated sprinkler head and nozzle assembly designed to receive deflector as illustrated in FIG. 17(*a*) and FIG. 17(*c*) shows the assembly in FIG. 17(*b*) fitted with such a deflector;

FIG. 22(*b*) is a side of the deflector shown in FIG. 17(*a*);

DETAILED DESCRIPTION OF THE INVENTION

Figure 1:
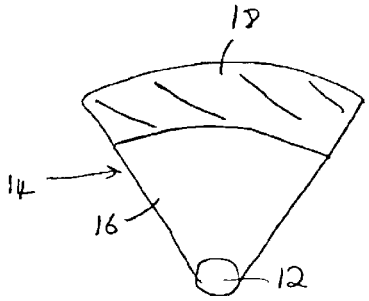
FIG. 1 is a schematic view of a conventional nozzle and the area it waters.

In the attached drawings, generally diagrammatic illustrations are provided regarding different forms of the sprinkler head and nozzle, as well as the patterns of watering effected by the particular nozzles.

As a general introduction, the invention can be described as a water deflector, either standing alone, or for use with a sprinkler nozzle used in irrigation systems, the water deflector being positioned about the outlet of the sprinkler nozzle in such a manner so as to, at least partially, interrupt the flow stream of the water discharged from the sprinkler head or nozzle in a manner which would enhance the area to which water is provided by the sprinkler head and nozzle. Generally, enhancement of the area watered means that, with the water deflector, watering occurs over that area in a more consistent and even manner, substantially preventing dry or unwatered areas on the one hand, and over-watering of remaining areas on the other.

It should also be understood that the invention relates to water deflectors, either standing alone, or attached to nozzles which may commonly be used with fire hoses, garden hoses and the like for the purposes of achieving an enhanced watering of a particular area to facilitate evenness and consistency of watering over that area.

Conventional sprinkler heads or nozzles are placed within an irrigation system with the intention that an area adjacent the sprinkler head receive water. The shape of this area may vary depending upon the construction of the sprinkler nozzle. Thus, depending upon the configuration of the water outlet in the sprinkler nozzle, the area watered may be in the shape of a quadrant, a half-circle, a full circle, or, indeed, any particular portion of a circle. Additionally, the sprinkler nozzle may be configured so as to water a particular strip, which may be a rectangular shaped area, with the sprinkler nozzle generally in the middle thereof. As mentioned, the water discharged from the sprinkler nozzle is generally ejected upwardly and outwardly. The purpose of such a mechanism would be, of course, to enable the water to reach the distant perimeter of the half-circle, full circle or the like. However, a common deficiency encountered with respect to such sprinkler nozzles is that, since the water is being discharged upwardly and outwardly, the outer reaches of the area intended to be covered will receive water, but those areas and spaces nearer the sprinkler nozzle will receive no or little water.

The water deflector for use with a sprinkler nozzle, or formed as part of a sprinkler nozzle, of the present invention is intended to address this common deficiency encountered in sprinkler nozzles so as to provide more even and consistent watering over the entire area. This will allow for proper distancing of sprinkler heads in an irrigation system with respect to each other so as to be more economical, more effective at watering, and require less overlap to take into account the deficiencies in terms of reach and watering consistency.

More particularly, the invention provides a water deflector which enables areas nearer the sprinkler head to be watered, such areas often being missed due to the upward and outward discharge of the water stream from the sprinkler nozzle.

Reference is now, made to the accompanying drawings. In FIG. 1, there is diagrammatically shown a conventional nozzle 12, and area of watering 14, the area of watering 14 being represented in this figure having a quadrant shape. Since this figure is merely illustrative, it should be appreciated that the invention is not in any way limited to watering a quadrant area or, indeed, any specific shaped area at all.

The area of watering 14 comprises an inner portion 16 and an outer portion 18. Due to the upward and outward nature of the discharge of water from the nozzle 12, the area represented by the outer portion 18 tends to obtain all or most of the water being discharged from the nozzle 12. As a result, the inner portion 16, representing the area nearer the nozzle 12, receives less water, and this portion, or certain parts of it, may indeed receive no water at all.

Figure 2:
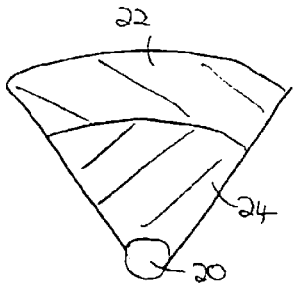
FIG. 2 is a schematic view of a nozzle incorporating a deflector of the invention, and the area it is intended to water.

FIG. 2 of the drawings shows a diagrammatic representation of area watered when a nozzle 20, equipped with a water deflector in accordance with the invention (not shown in FIG. 2, but illustrated in subsequent Figures) is used. The nozzle 20, with appropriately deflected water emerging therefrom, waters not only the outer portion 22, but also ensures that the inner portion 24 receives water as well. Preferably, the watering over the outer and inner portions 22 and 24 respectively would be substantially consistent in terms of volume received over a particular period of time.

Figure 3:
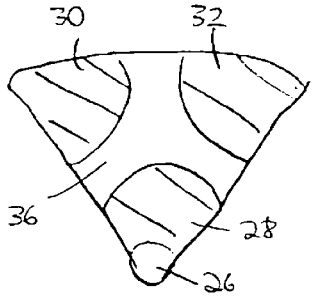
FIG. 3 is a nozzle including one particular deflector of the invention, and showing the area that it waters.

As will be described below, one of the important features of the water deflector of the invention is a hole, slot or aperture or the like therein. It has been indicated from appropriate testing that the absence of this hole, slot or aperture can cause a different pattern of watering, and this is shown in FIG. 3 of the drawings. Thus, the nozzle 26 shown in FIG. 3 incorporates a water deflector (not shown) without the aperture or slot, and the watering pattern achieved is such that some water is received in the area nearer the nozzle, identified as near portion 28, while outer corner portions 30 and 32 also receive water. However, a central portion 36 tends not to receive water, or significant quantities of water. In order to achieve more even distribution, the water deflector should preferably incorporate the hole or aperture, as will be described below, to effect the consistency of watering which can be achieved in accordance with the invention.

Figure 4:
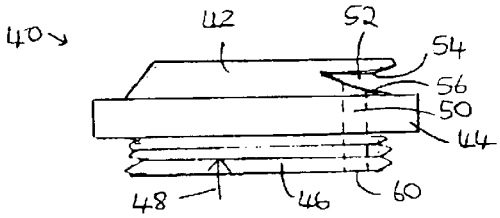
FIG. 4 is a schematic side view of a conventional sprinkler nozzle.
Figure 5:
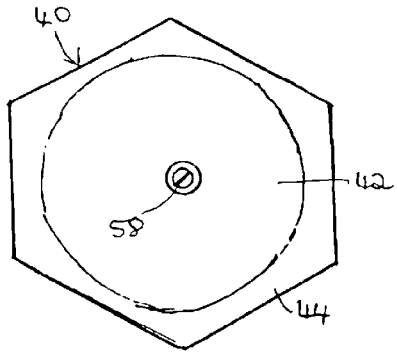
FIG. 5 is a top view of the sprinkler nozzle shown in FIG. 4.
Figure 6:
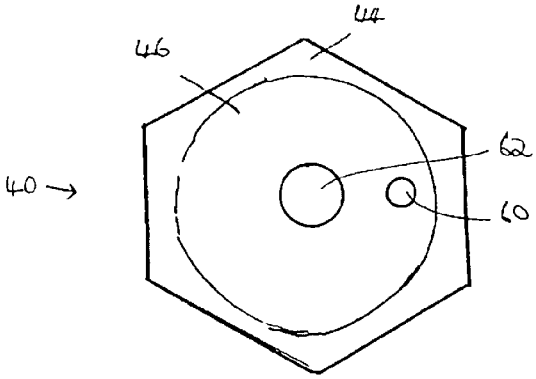
FIG. 6 is a bottom view of the sprinkler nozzle shown in FIG. 4.

FIGS. 4, 5 and 6 show a side view, top view and bottom view respectively, in diagrammatic form, of a nozzle 40 for use in an irrigation system, the nozzle being one able to receive a water deflector designed in accordance with the invention. The nozzle 40 comprises a top section 42, a mid-section 44, and a bottom section 46. As will be seen in FIG. 4, the bottom section has an outer screw thread, which allows the nozzle 40 to be attached to, in a conventional manner, a head and appropriate piping in an irrigation system. Water comes up through such pipe, not shown, in the direction indicated by arrow 48.

A water channel 50, preferably having an axis substantially parallel to that of the nozzle 40, extends through the bottom section 46, mid-section 44 and into top section 42. The top section 42 has a cut-out or mouth, defined by a generally vertical wall 54, and an angled wall 56. Water to be discharged from the nozzle 40 passes through the channel 50, and from the channel 50 into the mouth 52. The force with which the water is discharged from the channel 50, coupled with the configuration of the vertical and angled walls 54 and 56 respectively, cause the water to be dispensed up and out over an area, which can generally be illustrated as one following the pattern shown in FIG. 1 of the drawings.

With reference to FIG. 5, the top section 42 has a screw 58 to regulate the volume of water flowing through the nozzle. FIG. 6 shows the bottom section 46, the mid-section 44 and the inlet 60 to the water channel 50. FIG. 6 also shows a volume adjustment plate 62 which allows for adjustment of water flowing through the nozzle 40, as well as the pressure thereof entering the inlet 60 and passing through the water channel 50. Such adjustment mechanisms are fairly conventional, and will not be further described herein.

Figure 7:
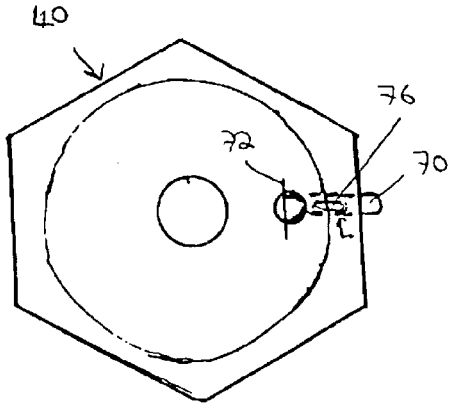
FIG. 7 is a bottom view of the sprinkler nozzle shown in FIG. 4, and including a water deflector of the invention.
Figure 8:
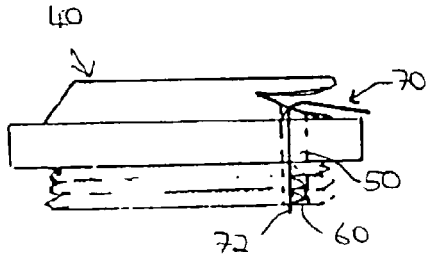
FIG. 8 is a side view of the sprinkler nozzle shown in FIG. 7.

FIG. 7 shows the nozzle 40, as shown in FIG. 4 of the drawings, but with a water deflector 70 of the invention inserted in the water channel 50. A side view of the arrangement in FIG. 7 can be seen in FIG. 8 of the drawings, also showing the nozzle 40 and the water deflector 70 located within the channel 50. The shape and configuration of the water deflector 70 is illustrated in FIGS. 9 to 11 of the drawings, as will now be described.

Figure 9:
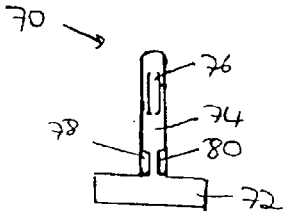
FIG. 9 is a front view of a water deflector for use with a sprinkler nozzle, in accordance with the invention.

FIG. 9 illustrates the front view of a water deflector 70 comprising a base 72 and upwardly extending shaft 74. Both the base 72 and shaft 74 are comprised of a thin metal or plastic strip. An elongated slot or aperture 76 is formed within the upper portion of the shaft 74. Near the base of the shaft 74 is a pair of flanges 78 and 80 which, as will be described briefly below, facilitate the proper positioning of the shaft 74 within the water channel 50.

The base 72 generally has a width which exceeds the diameter of the channel 50 so that when the water deflector 70 is inserted within the channel 50, as will be described below, it will remain in place, and the pressure of the water will not cause the water deflector 70 to be forced out of the water channel 50.

Figure 10:
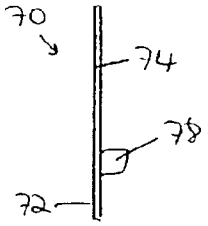
FIG. 10 is a side view of the water deflector shown in FIG. 9.
Figure 11:
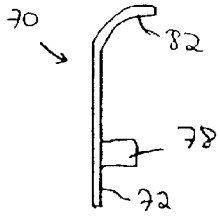
FIG. 11 is a side view of the water deflector shown in FIG. 9, but having been bent to deflect water.

FIG. 10 shows a side view of the water deflector 60 illustrated in FIG. 9, where the same reference numerals have been used to describe the various components. With respect to FIG. 11, this shows another side view, but wherein the upper end 82 of the shaft 74 is arcuate in shape, either because the shape has been configured into the water deflector 70 in the manufacturing process, or because it has been bent over so that the generally vertical shaft 74 in FIG. 10 assumes the arcuate shape.

With respect to the arcuate upper end 82, in one preferred embodiment, the water deflector 70 is comprised of a malleable material, such as a metal, which can be deflected or bent into a position within a nozzle 40 so as to interrupt a portion of the stream of water passing therethrough and thereby provide optimal coverage of the area watered by the nozzle.

Figure 12:
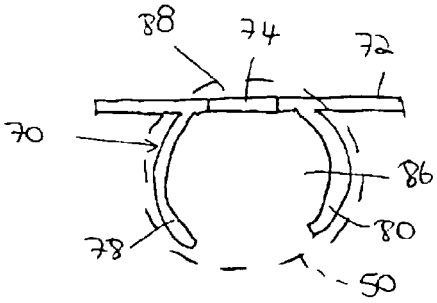
FIG. 12 is a top view of the deflector shown in FIG. 9.

FIG. 12 of the drawings shows a top view of the water deflector 70 illustrated in FIG. 9 of the drawings. It will be noted that shaft 74 extends upwardly, and the flanges 78 and 80 position the deflector 70 within the water channel 50. In FIG. 12, the water channel 50 is shown in phantom lines, to show the relative position of the water deflector 70 therein. From this figure, it will be seen that the flanges 78 and 80 act against the side walls of the channel 50 so that the shaft 74 preferably tends to be near, although not directly adjacent, the wall of the channel 50. This preferred positioning of the deflector 70 within the channel 50 provides a main water stream area 86, in front of the shaft 74 and between the flanges 78 and 80, and a secondary water stream area 88 behind the shaft 74. Thus, water is able to flow on both sides of the shaft, a feature which itself enhances the consistent dispersal of water over the area to be covered.

Figure 13:
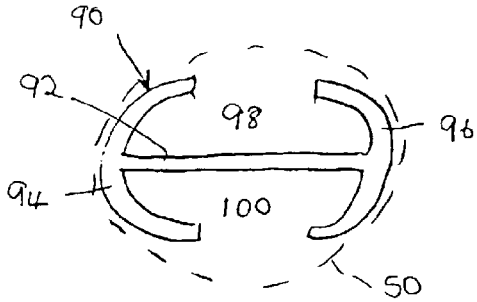
FIG. 13 is a top view of another embodiment of a deflector.
Figure 15:
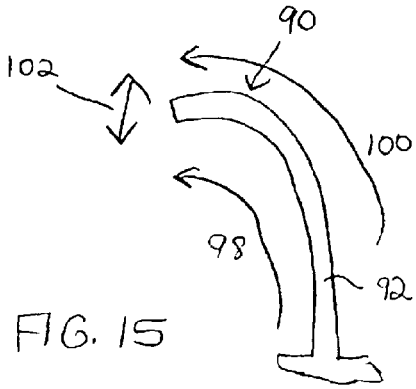
FIG. 15 is a schematic side view of a water deflector of the invention, comprised of plastic, part of which oscillates in response to water pressure.

With reference to FIG. 13, a top view of a water deflector 90, in accordance with another embodiment of the invention, is shown. In this embodiment, the shaft 92 extends upwardly, and semi-circular flanges 94 and 96 are located at each side edge of the shaft 92, and in this embodiment, positions the shaft 92 somewhat centrally within the channel 50. This structure of water deflector 90 may be particularly suitable when the water deflector is constructed of a plastics material, from a plastic mold. In FIG. 13, two substantially equivalent water stream areas 98 and 100 are provided which flow over the shaft, deflecting the water for optimal dispersal. FIG. 15 of the drawings shows a side view of the water deflector 90 shown in FIG. 13 of the drawings, and the arrows in this drawing show the water streams 98 and 100 on each side of the shaft 92. The shaft 92 is arcuate at its upper end, which is located in the mouth or outlet of a nozzle 40. When constructed of plastic the water deflector 90 shown in FIG. 15 may, under the pressure of the water, reciprocate or oscillate rapidly in an up-and-down motion, as indicated by arrow 102. This up-and-down reciprocation alternately directs the water somewhat higher and somewhat lower, the overall effect of which is to provide optimal and consistent dispersal rates of the water in the area to be covered.

Figure 14:
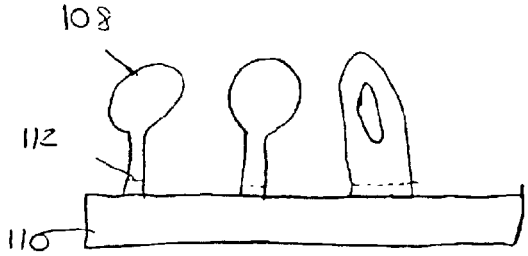
FIG. 14 comprises a plurality of water deflectors, mounted on a base.

With reference to FIG. 14, there is shown molded or manufactured water deflectors 108 on a base piece 110. The water defectors 108 have a point of weakness 112 near their connection with the base part 110, so that they can be easily snapped off. This arrangement allows for the convenient sale and storage of a plurality of water defectors, which may be of the same or different shapes and configurations, so that the user can simply snap one off the base 110 when required.

FIGS. 16 to 21 show various embodiments of the water deflector of the invention, including different features and shapes which may be of particular importance when providing for a specific application.

Figure 16:
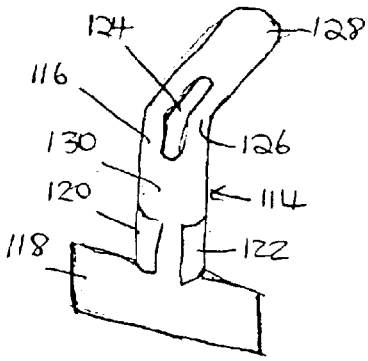
FIG. 16 is a perspective schematic view of one form of the water deflector of the invention.

FIG. 16 of the drawings shows a single concept water deflector 114 including a shaft 116, a base 118, and flanges 120 and 122. An aperture 124 is provided in the shaft 116. It will be noted that in the embodiment shown in FIG. 16 the shaft 116 is bent in dog-leg fashion at bend 126 so that the outer portion 128 is positioned at an angle compared to the inner portion 130. The slot or aperture 124 extends approximately equidistantly from the bend point 126. The flanges 120 and 122 position the water deflector 114 appropriately within the channel 50, and the base 118 prevents the water deflector 114 from being forced out of the channel 50 due to the pressure of the water.

Figure 17A:
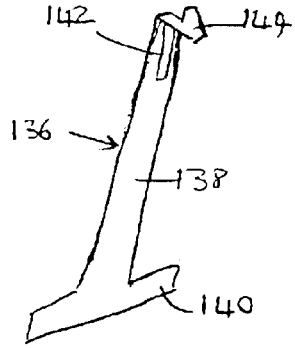
FIG. 17(*a*) is a schematic front view of another embodiment in accordance with the invention.
Figure 17B:
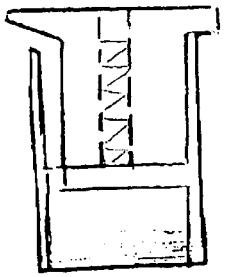
Figure 17C:
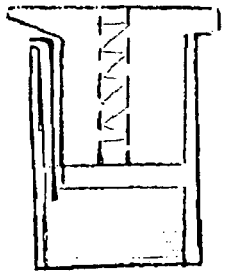

FIG. 17(*a*) shows a water deflector 136 including a shaft 138 and base 140. The shaft 138 includes a slot 142. The uppermost tip 144 of the shaft 138 is bent over at approximately right angles to the remainder of the shaft 138, to provide a variation in the watering pattern. This configuration is designed for a model where the nozzle fits snugly within the head and no projections from the head can be accommodated. Thus, the deflector should be contained wholly within the nozzle so that it does not impede the nozzle/head retraction mechanism when the sprinkler is not in use. FIGS. 17(*b*) and (*c*) illustrate the preferred type of retractable nozzle and head assembly, with the deflector 136 inserted into the assembly in FIG. 17(*c*) of the drawings.

Figure 18A:
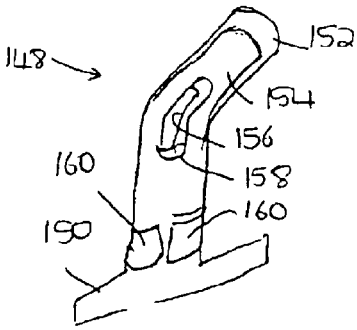
FIG. 18(*a*) shows a multiple-shaft water deflector, and FIG. 18(*b*) is a schematic representation of water dispersal therefrom.
Figure 18B:
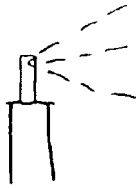

FIG. 18(*a*) shows a water deflector 148 having a base 150 and multiple shafts 152 and 154. Each shaft 152 and 154 has an aperture 156 and 158 respectively which substantially overlap with each other. Flanges 160 are provided for proper positioning of the water deflector 158 within a channel. In FIG. 18(*b*), there is a schematic representation of the effect produced by the water deflector 148 shown in FIG. 18(*a*), which provides full and consistent coverage of the area to be watered.

Figure 19:
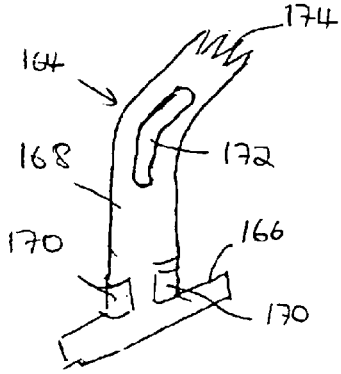
FIG. 19 shows a forked end water deflector.

Yet another embodiment of the water deflector is shown in FIG. 19. In this Figure, water deflector 164 comprises a base 166, shaft 168 and flanges 170, as previously described. The shaft 168 includes the usual slot or aperture 172. The end 174 of the shaft 168 has a forked configuration, which itself influences the nature of the interruption of the water stream, and hence the nature of the dispersal of the water in the area covered. The forked end 174 generally has the effect of directing less water spray to the ground near the nozzle.

Figure 20:
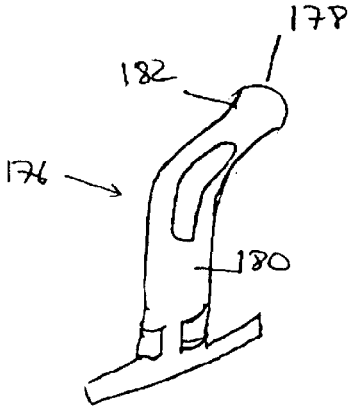
FIG. 20 shows a flared end water deflector.

In FIG. 20, there is shown a water deflector 176, in this case having a flared end 178, wherein the shaft 180 has a narrow or tapered portion 182, and a flared or bulbous end 178. Once more, this particular shape affects the nature of the water dispersal, in this case directing a wider spray to the area near the head.

Figure 21:
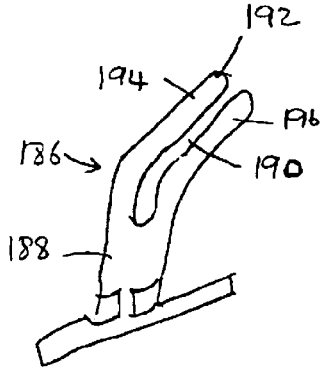
FIG. 21 shows a split-end water deflector in accordance with the invention.

With respect to FIG. 21 of the drawings, a water deflector 186 includes a shaft 188 having a slot 190 such that the slot 190 is open at the end 192 of the shaft. The split end water deflector 186 allows each elongate component 194 and 196 to be independently bent with respect to each other, and thus provides the user with some flexibility for adjustment in order to achieve an optimum pattern of watering in a given condition. Although one split is shown in FIG. 21 of the drawings, a water deflector may have more than one split, producing several arm components, each of which can be independently adjusted according to the nature of the area to be watered.

Figure 22A:
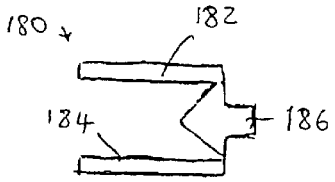
FIG. 22(*a*) shows a schematic top view of deflector connected to the outside of a nozzle.
Figure 22B:
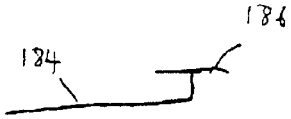
Figure 23:
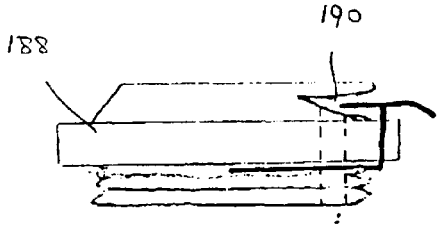
FIG. 23 shows a nozzle fitted with a deflector as shown in FIG. 22(*a*) of the drawings.
Figure 24:
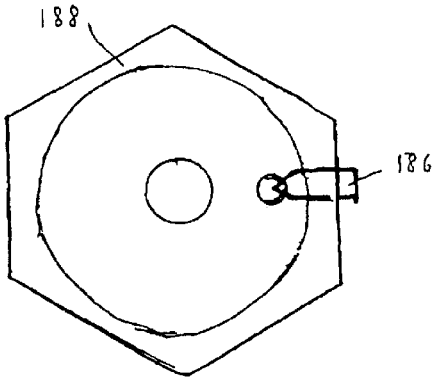
FIG. 24 is a top view of the nozzle shown in FIG. 23 of the drawings.

FIGS. 22(*a*) and (*b*) show a deflector 180 having a pair of arms 182 and 184. A deflector plate 186 is formed between the two arms 182 and 184. In use, the deflector 180 is slid onto a nozzle 188 in the manner illustrated in FIG. 23. The plate 186 is located in or about the mouth 190 to deflect the stream, as discussed above. This arrangement can also be seen in FIG. 24 of the drawings which shows a top view of the nozzle 188 and the appropriately located plate 186. When attached, the arms 182 and 184 locate outside the nozzle's lower section 46 and are held in place when the nozzle 40 is screwed into an appropriate head (not shown).

Figure 25:
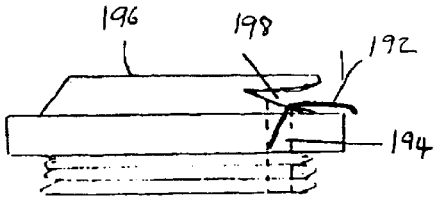
FIG. 25 shows a nozzle/deflector assembly with the deflector attached to the nozzle.

FIG. 25 shows a deflector 192 having a shaft which is attached, substantially permanently, in the water channel 194 of nozzle 196. Although the deflector 192 is shown as being attached within the channel 194, it can also be attached elsewhere on the nozzle, such as in the mouth area 198.

While many different embodiments of particular water deflectors have been shown and described above, it will be appreciated that the invention is not intended to be limited to any one or only those described herein. Rather, the variety of examples is intended only to exemplify the wide range in flexibility provided by a water deflector which can be used with a nozzle in order to achieve the best water coverage for a particular area to be watered.

It should also be appreciated that a nozzle 40 may have, as part of the manufacturing process, affixed thereto a water deflector of the invention, so that the invention comprises the composite of the nozzle as well as the deflector as a unitary product. However, the invention also relates only to the water deflector itself, which may come in many different embodiments, and which can be manually or automatically inserted and removed, as appropriate, from nozzles which have not been fitted with such water deflectors.

In operation, the water deflector, when standing alone, can be easily inserted within a nozzle 40. The nozzle 40 is disconnected from the irrigation system, usually by unscrewing it from the main piping, or offshoot piping for that nozzle. The water deflector is then pushed through the inlet 60, and into the channel 50 of the nozzle. The end thereof may then either project out through the mouth 52 or reside within the nozzle depending upon the configuration of the nozzle and/or head. This is well illustrated in FIG. 8 of the drawings. The flanges are constructed so as to keep the water deflector appropriately located, for the best dispersal of water, within the channel 50. The water deflector cannot be pushed out through the channel by virtue of the water pressure since the base on the water deflector, such as 72 in FIG. 9 of the drawings, acts on and is stopped by the underside of the bottom section 46 of the sprinkler nozzle 40. With the water deflector located in the channel 50 and mouth 52, the end of the deflector can be adjusted by bending it up or down respectively to achieve the best watering configuration.

Water runs up through the channel on both sides of the shaft, and the water deflector ensures that some of the water, at least, goes to areas nearer the sprinkler head, which may have been previously unwatered. The elongate hole or slot, common to all of the water deflectors in a preferred embodiment thereof, ensures that the water pressures and transfer across and through the water deflector takes place, and facilitates consistency of watering.

The invention therefore provides an effective device for directing a portion of the water that issues from a sprinkler nozzle to an area near the head, while allowing the remaining portion of water to be dispersed to more distant areas. The flanges are effective not only in properly seating the shaft appropriately within the channel, but also stabilize the water deflector within the channel so as to prevent rotation thereof under the pressure of the water stream. While the water deflector is to some extent bendable, it will not, under normal circumstances, change shape in response to the pressure of water flowing over and through it. Further, the base ensures that the water deflector stays fixed and does not pass through the channel. The base may extend out linearly in a straight line, or may be circular or semi-circular. The shape is not of particular importance in most cases, as long as it is wider than the channel so as to prevent discharge of the water deflector under pressure.

Generally, the location of the slot within the shaft allows water to pass therethrough. In most embodiments, the slot does not extend to the end of the shaft, and the end piece thereof is generally important in diverting a portion of the water to direct it downwards and nearer the area at the base of the sprinkler head, which might otherwise have gone unwatered.

The water deflector may be constructed of any suitable material, including metals such as non-ferrous metals, plastic, composite material or other durable rust resistant materials.

The length of the shaft itself may be variable, so that either less or more of such length extends outwardly through the mouth 52 of the nozzle 40. By varying the length of the shaft, a particular water deflector can be tailored so as to produce the optimal watering consistency desired by the user.

The invention is not limited to the precise details described above and may vary in accordance with the general description and the following claims.

What is claimed is:

1. A water deflector for use with an nozzle having a water channel including a water inlet and a mouth from which water is dispersed, the water deflector comprising:

a shaft for passing through the water channel of the nozzle, the shaft having a lower end and an outer end and an aperture along a part of the shaft between the lower and outer ends; and a base member connected to the shaft at the lower end thereof, the base member having a width sufficiently large to prevent, in use, the base member from entering the water inlet of the water channel;

wherein a portion of water passing through the water channel is deflected by the water deflector to alter the pattern of watering about the nozzle.

2. A water deflector as claimed in claim 1 wherein the shaft is in the form of an elongate flat plate.

3. A water deflector as claimed in claim 1 wherein the base member comprises a substantially linear flat plate member.

4. A water deflector as claimed in claim 1 wherein the base member ranges in shape from a substantially linear to a substantially circular member.

5. A water deflector as claimed in claim 1 further comprising a flange mounted on the shaft above the base member, the flange in use positioning the shaft optimally within the water channel.

6. A water deflector as claimed in claim 1 wherein the shaft is configured with respect to its length and shape so as to provide optimal water distribution for the pattern of watering about the nozzle.

7. A water deflector as claimed in claim 6 wherein the optimal distribution comprises a substantially consistent and even distribution of water over the pattern of watering.

8. A water deflector as claimed in claim 1 wherein the aperture comprises an elongate slot formed in the shaft near the upper end thereof, such that the slot is formed at a position wherein it will be located at or near the mouth of the nozzle.

9. A water deflector as claimed in claim 1 wherein the shaft is bent near its end opposite that of the base member in an arcuate form.

10. A water deflector as claimed in claim 1 wherein the water deflector is comprised of a material selected from the group consisting of metal, non-ferrous metal, composite material and plastic.

11. A water deflector as claimed in claim 1 comprising a plurality of shafts superimposed with respect to each other.

12. A water deflector as claimed in claim 1 wherein the end of the shaft opposite that of the base member has a forked configuration.

13. A water deflector as claimed in claim 1 wherein the end of the shaft opposite that of the base member has a flared configuration.

14. A water deflector as claimed in claim 1 wherein the aperture comprises a slot extending along the shaft all the way to the end thereof such that the shaft comprises a pair of independently movable arms.

15. A water deflector as claimed in claim 1 wherein no flanges are located on the shaft.

16. A nozzle comprising:

a water channel having an inlet end for receiving water from a source and an outlet end from which the water is discharged to an area adjacent the nozzle; and a water deflector comprising a substantially flat shaft at the outlet end, the shaft having an aperture in the form of an elongate slot to permit flow of water therethrough, and means for securing the shaft to the nozzle.

17. A nozzle as claimed in claim 16 wherein the shaft comprises a first end attached near the outlet end of the water channel, and a second end remote from the outlet end.

18. A nozzle as claimed in claim 16 wherein the shaft further comprises a base member, the base member being located outside the water channel at the inlet end thereof and connected to an end of the shaft, the shaft further comprising a flange within the water channel for optimal positioning of the shaft within the water channel.

19. A nozzle as claimed in claim 16 wherein the water deflector is attached to the nozzle.

* * * * *